US009387643B2

(12) United States Patent
Satoh et al.

(10) Patent No.: US 9,387,643 B2
(45) Date of Patent: Jul. 12, 2016

(54) SHEET PROCESSING APPARATUS AND IMAGE PROCESSING SYSTEM

(71) Applicants: Shohichi Satoh, Kanagawa (JP); Makoto Hidaka, Tokyo (JP); Satoshi Saito, Kanagawa (JP); Mamoru Kambayashi, Tokyo (JP); Tomomichi Hoshino, Kanagawa (JP); Atsushi Kikuchi, Kanagawa (JP); Kiyoshi Hata, Tokyo (JP); Keisuke Sugiyama, Kanagawa (JP)

(72) Inventors: Shohichi Satoh, Kanagawa (JP); Makoto Hidaka, Tokyo (JP); Satoshi Saito, Kanagawa (JP); Mamoru Kambayashi, Tokyo (JP); Tomomichi Hoshino, Kanagawa (JP); Atsushi Kikuchi, Kanagawa (JP); Kiyoshi Hata, Tokyo (JP); Keisuke Sugiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 110 days.

(21) Appl. No.: 14/508,991

(22) Filed: Oct. 7, 2014

(65) Prior Publication Data

US 2015/0115516 A1 Apr. 30, 2015

(30) Foreign Application Priority Data

Oct. 25, 2013 (JP) ..... 2013-222463

(51) Int. Cl.

| | |
|---|---|
| ***B65H 45/12*** | (2006.01) |
| ***B31F 1/00*** | (2006.01) |
| ***B65H 45/18*** | (2006.01) |
| ***B65H 45/04*** | (2006.01) |
| ***B65H 31/34*** | (2006.01) |
| ***G03G 15/00*** | (2006.01) |

(52) U.S. Cl.

CPC ..... *B31F 1/0035* (2013.01); *B31F 1/00* (2013.01); *B31F 1/0006* (2013.01); *B65H 31/34* (2013.01); *B65H 45/04* (2013.01); *B65H 45/12* (2013.01); *B65H 45/18* (2013.01); *G03G 15/6541* (2013.01); *B65H 2301/51232* (2013.01); *B65H 2701/13212* (2013.01); *B65H 2801/27* (2013.01); *G03G 2215/00877* (2013.01)

(58) Field of Classification Search

CPC ..... B31F 1/00; B31F 1/006; B31F 1/0035; B65H 45/04; B65H 45/12; B65H 2801/27

USPC ..... 270/32, 45, 58.07

See application file for complete search history.

(56) References Cited

U.S. PATENT DOCUMENTS

| | | | | |
|---|---|---|---|---|
| 6,905,118 | B2 * | 6/2005 | Yamada | B65H 45/18 270/20.1 |
| 7,762,536 | B2 * | 7/2010 | Fukatsu | B65H 33/00 270/20.1 |
| 7,950,643 | B2 * | 5/2011 | Kawaguchi | B65H 37/04 270/37 |

(Continued)

FOREIGN PATENT DOCUMENTS

| | | |
|---|---|---|
| JP | 06105149 A | 4/1994 |
| JP | 2012-020882 | 2/2012 |

(Continued)

*Primary Examiner* — Leslie A Nicholson, III

(74) *Attorney, Agent, or Firm* — Duft Bornsen & Fettig LLP

(57) ABSTRACT

A sheet processing apparatus comprises a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member.

7 Claims, 17 Drawing Sheets

(56) References Cited

U.S. PATENT DOCUMENTS

| | | | | |
|---|---|---|---|---|
| 8,083,218 | B2 * | 12/2011 | Dobashi | B65H 45/18 270/32 |
| 8,342,497 | B2 * | 1/2013 | Abe | B42B 4/00 270/37 |
| 2008/0315481 | A1 | 12/2008 | Iguchi et al. | |
| 2008/0315482 | A1 | 12/2008 | Iguchi et al. | |
| 2008/0315483 | A1 | 12/2008 | Iguchi et al. | |
| 2008/0315484 | A1 | 12/2008 | Iguchi et al. | |
| 2008/0315485 | A1 | 12/2008 | Iguchi et al. | |
| 2008/0315486 | A1 | 12/2008 | Iguchi et al. | |
| 2008/0315487 | A1 | 12/2008 | Iguchi et al. | |
| 2008/0315488 | A1 | 12/2008 | Iguchi et al. | |
| 2010/0219575 | A1 | 9/2010 | Iguchi et al. | |
| 2011/0057375 | A1 | 3/2011 | Iguchi et al. | |
| 2011/0156333 | A1 | 6/2011 | Iguchi et al. | |
| 2011/0181917 | A1 | 7/2011 | Iguchi et al. | |
| 2011/0278784 | A1 | 11/2011 | Iguchi et al. | |
| 2014/0187407 | A1 | 7/2014 | Kikuchi et al. | |
| 2014/0203486 | A1 | 7/2014 | Sugiyama et al. | |
| 2014/0203488 | A1 | 7/2014 | Hidaka et al. | |
| 2014/0206516 | A1 | 7/2014 | Hata et al. | |
| 2014/0206518 | A1 | 7/2014 | Hidaka et al. | |
| 2014/0206519 | A1 | 7/2014 | Hoshino et al. | |
| 2014/0213425 | A1 | 7/2014 | Sugiyama et al. | |

FOREIGN PATENT DOCUMENTS

| | | | |
|---|---|---|---|
| JP | 2012144354 | A | 8/2012 |
| JP | 2012171727 | A | 9/2012 |

* cited by examiner (A)

(B)

(C)

SHEET PROCESSING APPARATUS AND IMAGE PROCESSING SYSTEM

CROSS-REFERENCE TO RELATED APPLICATIONS

The present application claims priority to and incorporates by reference the entire contents of Japanese Patent Application No. 2013-222463 filed in Japan on Oct. 25, 2013.

BACKGROUND OF THE INVENTION

1. Field of the Invention

The present invention relates to a sheet processing apparatus and an image processing system. More specifically, the present invention relates to an additional folding mechanism for reinforcing a fold line portion of a center-folded sheet bundle consisting of paper sheets, etc.

2. Description of the Related Art

Sheet such as a paper sheet and the like printed by an image forming apparatus, such as a copying machine, printer, or printing machine, is discharged from the image forming apparatus in some cases, and in other cases, a predetermined number of the printed sheets are bundled, then the sheet bundle is stitched in its center, and then the stitched sheet bundle undergoes center-folding processing for folding the sheet bundle in the center to be bundled into a booklet.

On the other hand, a conventional method has been known in which, in order to reinforce a fold line in a center-folded portion of a booklet constituted by a saddle-stitched sheet bundle, an additional folding operation for pressing the fold line portion is performed by using a roller which moves along the spine of the booklet.

For the additional folding operation, a configuration has been known in which a roller with a shaft axially directed in a direction perpendicular to the orientation of the fold line of a booklet presses the fold line portion while moving in a direction parallel to the orientation of the fold line.

For an additional folding unit used in an additional folding operation, a configuration has been employed in which an additional folding unit reciprocates in the widthwise direction of folded sheet bundle in accordance with the width of a maximum sheet size (e.g., see Japanese Patent Application Laid-open No. 2012-20882).

More specifically, a position on the side of one edge of the folded sheet bundle in the widthwise direction is previously set as a standby position for an additional folding unit, and the additional folding operation is performed in a forward motion for moving the additional folding unit from its standby position along the widthwise direction of the folded sheet bundle, while in a backward motion, the additional folding unit returns to its standby position.

In a conventional additional folding mechanism, time required for the additional folding mechanism to come back to the standby position after the additional folding from the standby position is completed may be determined in proportion to the sheet width. In other words, in a conventional configuration in which the standby position is set on the side of one edge of the folded sheet bundle in the widthwise direction, the same time as time required in completing an additional folding operation is also required to return the additional folding mechanism back to the standby position.

Accordingly, because operating time not directly related to the additional folding operation is required, a problem may arise such that the efficiency of the additional folding operation, particularly the additional folding operation performed on serially fed folded sheet bundles, becomes low.

In consideration of the above-described problem arising in conventional sheet processing apparatuses, there is a need to provide a sheet processing apparatus including a configuration capable of improving the working efficiency.

SUMMARY OF THE INVENTION

It is an object of the present invention to at least partially solve the problems in the conventional technology.

According to the present invention, there is provided a sheet processing apparatus comprising a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member.

The present invention also provides an image processing system which uses a sheet processing apparatus, the sheet processing apparatus comprising a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member, and the image forming apparatus is connected as a pre-stage apparatus and the sheet processing apparatus is connected as a post-stage apparatus at locations across a position in which saddle stitching and center folding of sheets are performed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of the present invention will be described with reference to examples illustrated in the attached drawings.

To begin with, before describing characteristics of the embodiments of the present invention, a configuration and operations of a sheet processing apparatus, which is an object of the present invention, will be described below.

Figure 1:
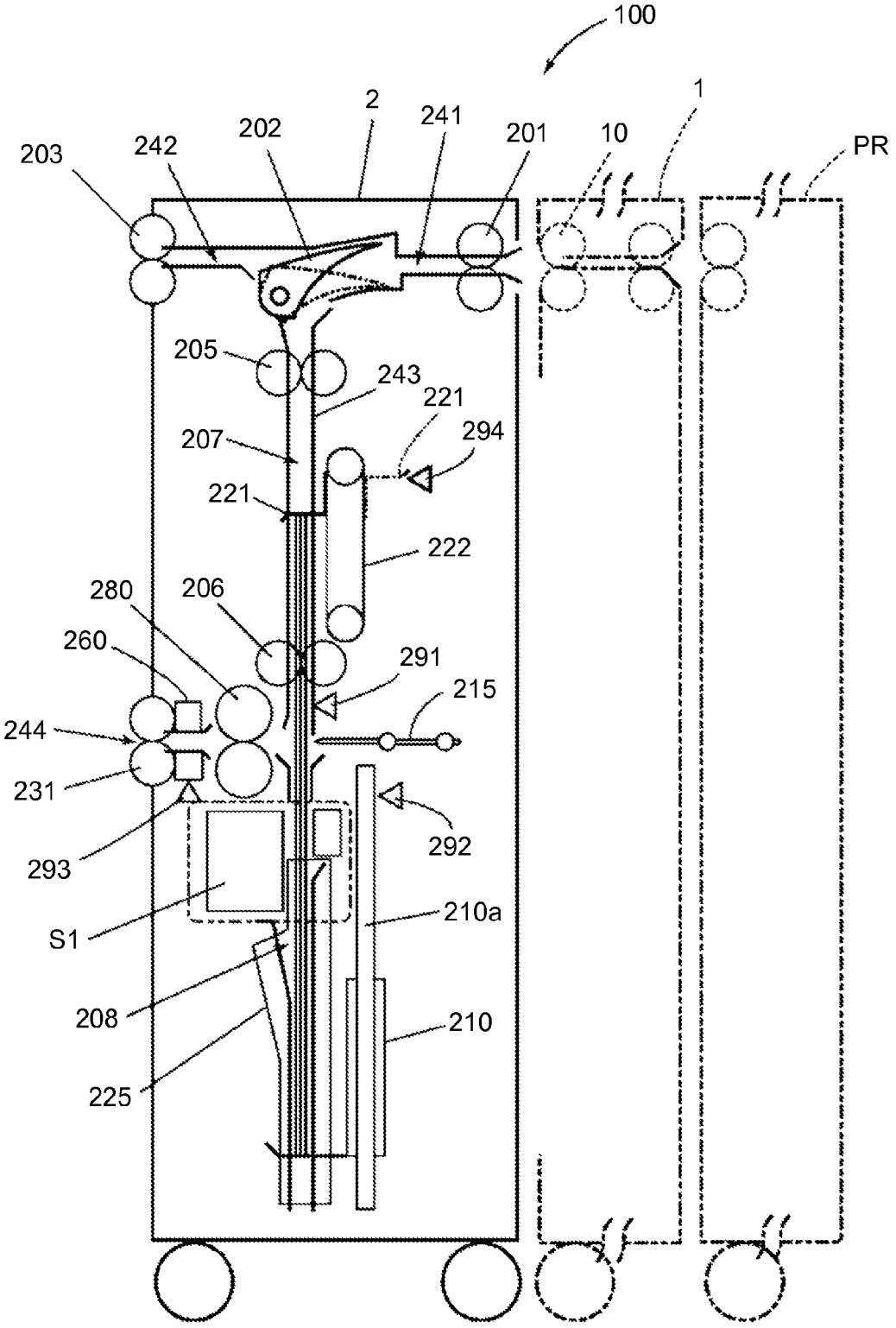
FIG. 1 is a diagram illustrating a system configuration of an image processing system including an image forming apparatus and a plurality of sheet processing apparatuses according to an embodiment of the present invention.

FIG. 1 is a diagram illustrating a system configuration of an image processing system 100 including an image forming apparatus and a plurality of sheet processing apparatuses according to the present embodiment. In the present embodiment, an image forming apparatus PR is provided as a pre-stage apparatus to first and second sheet processing apparatuses 1, 2, and the above-described first and the second sheet processing apparatuses 1, 2 are connected in this order as post-stage apparatuses.

The first sheet processing apparatus 1 is a sheet postprocessing apparatus including a sheet bundle forming function for receiving sheets one by one from the image forming apparatus PR, serially stacking the received sheets, aligning the stacked sheets, and forming a sheet bundle by using a stacking unit. In the first sheet processing apparatus 1, a sheet bundle is discharged to the second sheet processing apparatus 2, which is a post-stage apparatus, via sheet bundle discharge rollers 10.

The second sheet processing apparatus 2 is a saddle stitch binding apparatus configured to receive the conveyed sheet bundle and performs saddle stitching and center folding on the received sheet bundle (the second sheet processing apparatus may herein also be referred to as a "saddle stitch binding apparatus").

The saddle stitch binding apparatus 2 discharges the bound booklet (sheet bundle) without being further processed or to a post-stage sheet processing apparatus. The image forming apparatus PR forms a visible image on a sheet-like recording medium based on input image data or image data of a read image. A copying machine, a printer, a facsimile machine, or a digital multifunction peripheral including at least two of the functions of these machines and apparatuses, for example, are equivalent to the image forming apparatus PR. The image forming apparatus PR is an apparatus of a publicly known type, such as an electrophotographic type apparatus or a liquid droplet ejection type apparatus, for example, and methods of either of these types can be used as an image forming method.

In FIG. 1, the saddle stitch binding apparatus 2 includes an entrance conveyance path 241, a sheet-through conveyance path 242, and a center folding conveyance path 243. Entrance rollers 201 are provided in a most upstream portion of the entrance conveyance path 241 in a sheet conveyance direction, and an aligned sheet bundle is fed from the sheet bundle discharge rollers 10 of the first sheet processing apparatus 1 into the apparatus. Note that in the following description, the upstream side in the sheet conveyance direction will be simply referred to as an "upstream side", while the downstream side in the sheet conveyance direction will be simply referred to as a "downstream side".

A bifurcating claw 202 is provided on the downstream side of the entrance rollers 201 in the entrance conveyance path 241.

The bifurcating claw 202, which is disposed in the horizontal direction in FIG. 1, is configured to bifurcate the sheet bundle conveyance direction to either one of the sheet-through conveyance path 242 and the center folding conveyance path 243.

The sheet-through conveyance path 242, which extends horizontally from the entrance conveyance path 241, is a conveyance path for guiding the sheet bundle into a post-stage processing apparatus (not illustrated) or to a discharge tray (not illustrated). The sheet bundle is discharged by an upper discharge roller 203 to the post-stage apparatus.

The center folding conveyance path 243 extends vertically downward from the bifurcating claw 202 and is a conveyance path for performing saddle stitching and center folding processing on the sheet bundle.

The center folding conveyance path 243 is provided with an upper bundle conveyance guide plate 207, which guides the sheet bundle in a portion provided above a folding plate 215 for center-folding the sheet bundle, and a lower bundle conveyance guide plate 208, which guides the sheet bundle in a portion below the folding plate 215.

On the upper bundle conveyance guide plate 207, upper bundle conveyance rollers 205, a trailing edge tapping claw 221, and lower bundle conveyance rollers 206 are provided in this order from the top. The trailing edge tapping claw 221 is provided upright on a trailing edge tapping claw driving belt 222, which is driven by a drive motor (not illustrated). The trailing edge tapping claw 221 performs an operation for aligning the sheet bundle by tapping (pressing) the sheet bundle on its trailing edge toward a movable fence described below in accordance with a reciprocating rotation operation of the driving belt 222. In addition, when the sheet bundle is fed, and when the sheet bundle ascends for center folding, the trailing edge tapping claw 221 retracts from the center folding conveyance path 243 of the upper bundle conveyance guide plate 207 (to a position indicated by broken lines in FIG. 1).

A trailing edge tapping claw home position (HP) sensor 294 is a sensor for detecting a home position of the trailing edge tapping claw 221. The trailing edge tapping claw HP sensor 294 detects a position of the trailing edge tapping claw 221 retracted from the center folding conveyance path 243, which is indicated by the broken line in FIG. 1 (a position indicated by solid lines in FIG. 2) as the home position. The trailing edge tapping claw 221 is controlled by using this home position as the reference.

The lower bundle conveyance guide plate 208 is provided with a saddle stitching stapler S1, a saddle stitching jogger fence 225, and a movable fence 210, which are disposed in this order from the top. The lower bundle conveyance guide plate 208 is a guide plate for receiving the sheet bundle having been conveyed thereto from the upper bundle conveyance guide plate 207. The lower bundle conveyance guide plate 208 is also provided with a pair of the saddle stitching jogger fences 225 arranged in the widthwise direction. The movable fence 210, which is vertically movable in a state in which the sheet bundle abuts thereon (i.e., supported by the movable fence 210) on the leading edge, is provided below the saddle stitching jogger fence 225.

The saddle stitching stapler S1 is a stapler for stitching the sheet bundle in the center. The movable fence 210 is vertically movable while supporting the sheet bundle on the leading edge. With this configuration, when the sheet bundle is conveyed to a position in which the center of the bundle faces the saddle stitching stapler S1, the sheet bundle undergoes staple processing, i.e., saddle stitching.

The movable fence 210 is supported by a movable fence drive mechanism 210*a* and is capable of moving from the location of a movable fence HP sensor 292, which is provided above the movable fence 210 in FIG. 1, toward the lowermost position. For a movable range of the movable fence 210 to which the sheet bundle abuts on its leading edge, a stroke is secured large enough to enable processing on the sheet bundle of sizes ranging from the maximum to the minimum sizes supported by the saddle stitch binding apparatus 2. Note that for the movable fence drive mechanism 210*a*, a rack and pinion mechanism is used, for example.

A folding plate 215, a folding roller pair 280, an additional folding roller unit 260, and a lower discharge roller 231 are provided between the upper bundle conveyance guide plate 207 and the lower portion 208, i.e., in substantially the center of the center folding conveyance path 243.

The additional folding roller unit 260 is used for reinforcing the fold line of the sheet bundle by pressing on the fold line again. Upper and lower additional folding rollers are disposed across the discharge conveyance path provided between the folding roller pair 280 and the lower discharge roller 231.

The folding plate 215 can reciprocate in the horizontal direction in FIG. 1. A nip of the folding roller pair 280 is located in a direction of operation for performing a folding operation. A discharge conveyance path 244 is disposed on a line extended from the nip. The lower sheet discharge roller 231 is provided in the discharge conveyance path in the most downstream position and is configured to discharge the folded sheet bundle to a post-stage apparatus.

A sheet bundle detection sensor 291 is provided on the lower edge side of the upper bundle conveyance guide plate 207. The sheet bundle detection sensor 291 is configured to detect the leading edge of the sheet bundle fed into the center folding conveyance path 243 and passes the center folding position. In addition, a fold line portion passage sensor 293 is provided in a discharge conveyance path 244. The fold line portion passage sensor 293 is configured to detect the leading edge of the center-folded sheet bundle and recognize the passage of the center-folded sheet bundle.

To describe the outline, the saddle stitch binding apparatus 2 having a configuration illustrated in FIG. 1 performs saddle stitching and center folding operations as illustrated in the operation explanatory views of FIGS. 2 to 6. More specifically, when saddle stitching and center folding are selected via an operation panel (not illustrated) of the image forming apparatus PR, the sheet bundle for which saddle stitching and center folding have been selected is guided toward the center folding conveyance path 243 by a counterclockwise biasing operation of the bifurcating claw 202. Note that the bifurcating claw 202 is driven by a solenoid. The bifurcating claw 202 may also be driven by a motor instead of using the solenoid.

After being fed into the center folding conveyance path 243, the sheet bundle SB is conveyed by the entrance rollers 201 and the upper bundle conveyance rollers 205 downward through the center folding conveyance path 243, and the sheet bundle detection sensor 291 detects the passing state of the sheet bundle.

Figure 2:
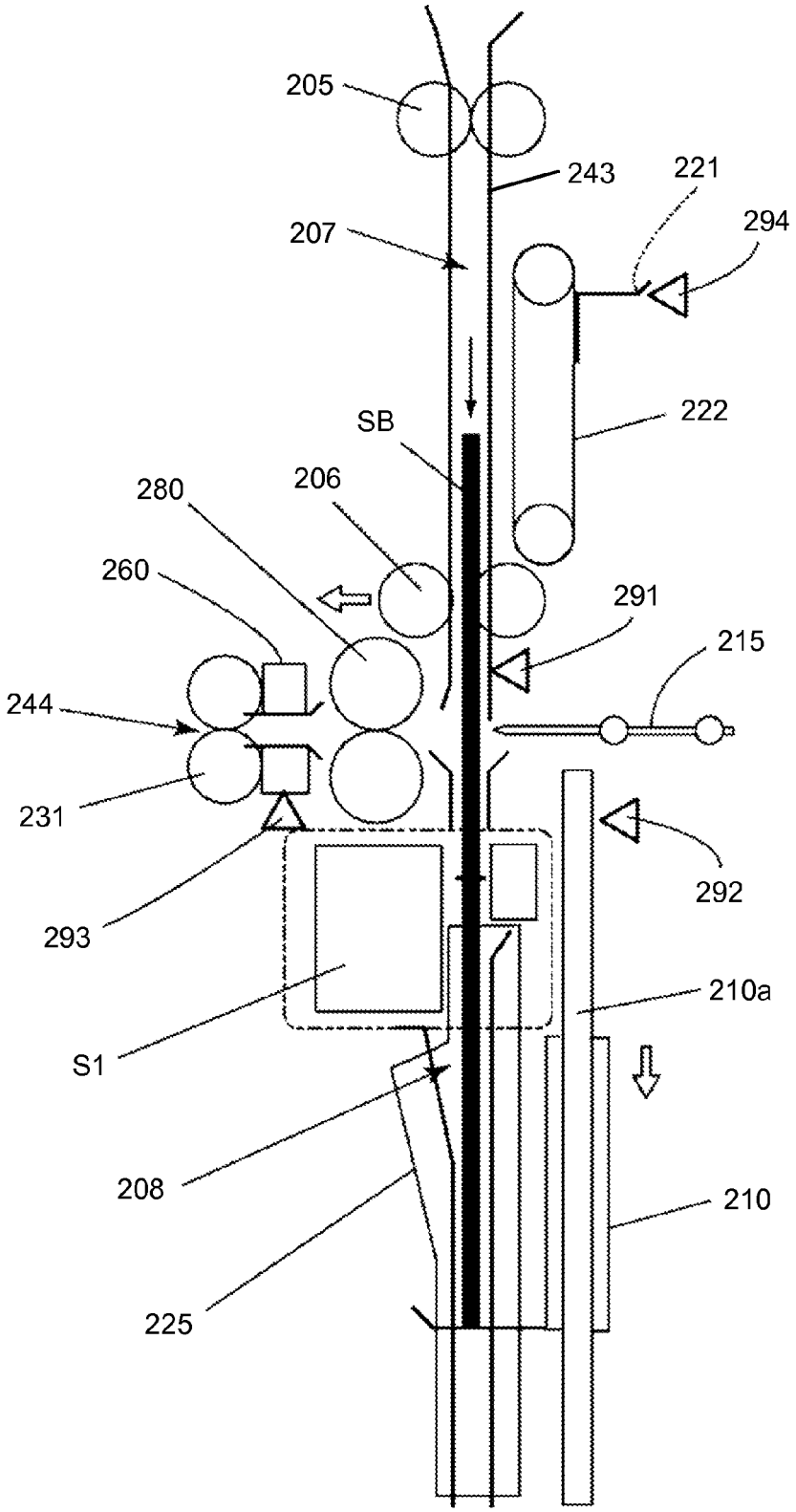
FIG. 2 is an operation explanatory diagram illustrating a state of a saddle stitch binding apparatus in which a sheet bundle has been fed into a center folding conveyance path.

After the passage of the sheet bundle SB is detected, the sheet bundle SB is conveyed by the lower bundle conveyance rollers 206 to a position at which the leading edge of the sheet bundle SB abuts the movable fence 210 as shown in FIG. 2. At this timing, the movable fence 210 stands by at a different stopping position according to sheet size information from the image forming apparatus PR, i.e., information about the size of each sheet bundle SB in the conveyance direction in this example. In this state in FIG. 2, the lower bundle conveyance rollers 206 have been pinching the sheet bundle SB in its nip and the trailing edge tapping claw 221 has been standing by at its home position.

Figure 3:
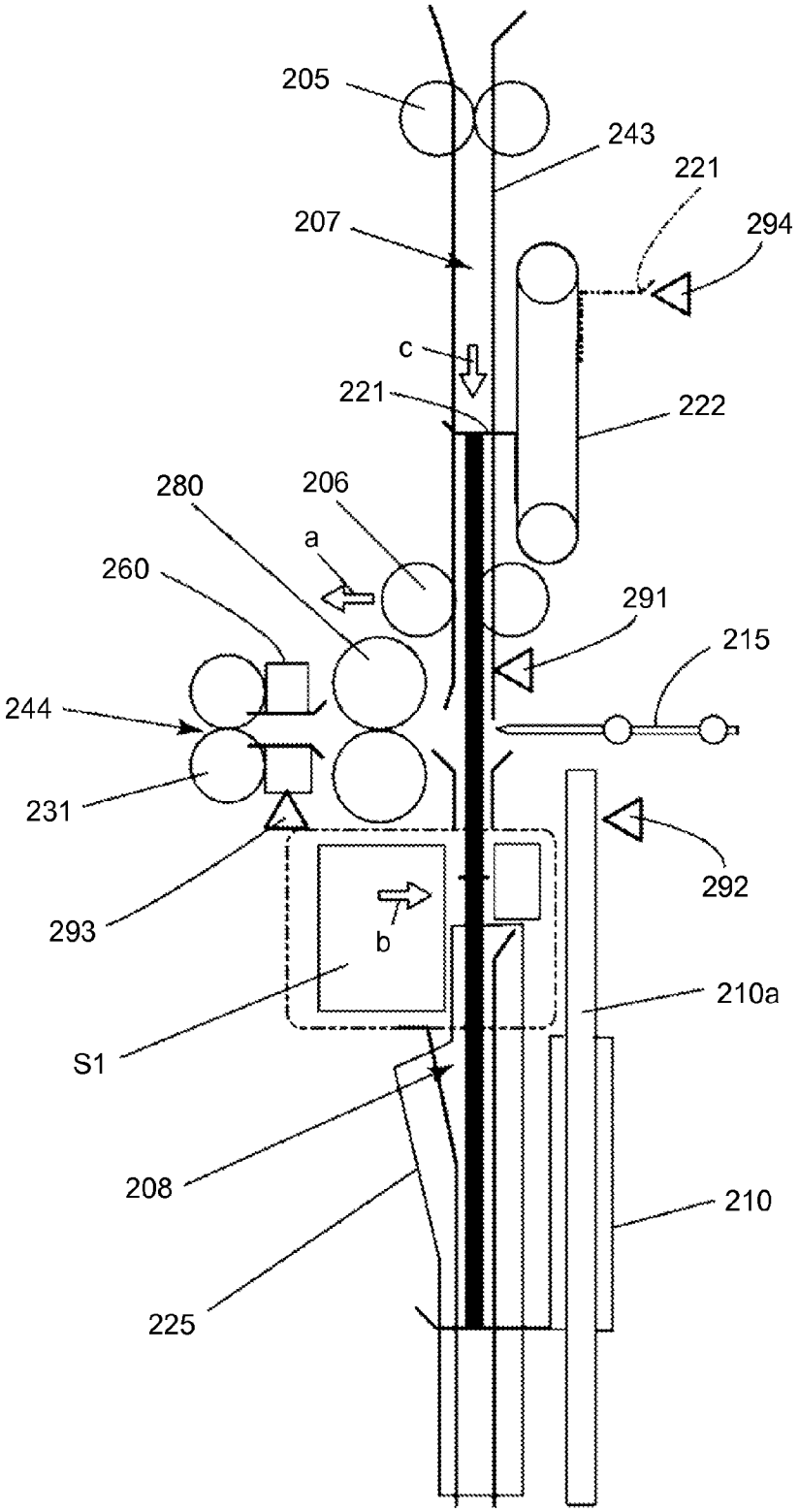
FIG. 3 is a diagram illustrating a state in which the sheet bundle is saddle-stitched by the saddle stitch binding apparatus.

In this state, the nipping pressure from the lower bundle conveyance roller 206 is released as shown in FIG. 3 (in a direction indicated by an arrow a). By performing this operation, the sheet bundle abuts the movable fence 210 on the leading edge thereof and the sheet bundle is stacked with its trailing edge being free, and then the trailing edge tapping claw 221 is driven to finally align the sheet bundle in the conveyance direction by tapping the sheet bundle SB on the trailing edge (in a direction indicated by an arrow c).

Subsequently, an operation for aligning the sheet bundle in the widthwise direction (in a direction perpendicular to the sheet conveyance direction) is completed by the saddle stitching jogger fence 225. In addition, an operation for aligning the sheet bundle in the conveyance direction is performed by using the movable fence 210 and the trailing edge tapping claw 221 respectively, and thus the operations for aligning the sheet bundle SB in the widthwise direction and the conveyance direction are completed.

In these operations, the amount of pressing by the trailing edge tapping claw 221 and the saddle stitching jogger fence 225 is controlled to an optimum value to perform the alignment according to sheet size information, information about the number of sheets included in the sheet bundle, and sheet bundle thickness information.

Further, because the space inside the conveyance path may decrease if the sheet bundle is very thick, the sheet bundle may not be appropriately aligned by performing the alignment operations only once in most cases. Accordingly, in such cases, the number of times of performing the alignment operations is increased. With this configuration, a better alignment state can be achieved. Further, because the time taken for serially stacking the sheets on the upstream side increases as the number of sheets increases, time taken for receiving a next sheet bundle SB becomes longer as the number of sheets increases. Thus, no loss of time may arise within the system if the number of times of alignment is increased, and as a result, a sufficiently aligned state can be efficiently achieved. Accordingly, the number of times of alignment can be controlled according to the processing time taken on the upstream side.

Note that a position in which the saddle stitching position for the sheet bundle SB faces the position of stitching by the saddle stitching stapler S1 is usually set as the standby position of the movable fence 210. This is because if the sheet bundle SB is aligned at this position, the stitching processing can be performed at the sheet bundle stacking position without moving the movable fence 210 to the saddle stitching position of the sheet bundle SB. Accordingly, in this standby position, a stitcher of the saddle stitching stapler S1 is driven in a direction indicated by an arrow b in the center of the sheet bundle SB. Then the sheet bundle SB is stitched between the stitcher and a clincher, and thus the sheet bundle SB is saddle-stitched.

The movable fence 210 is positioned by a control performed according to pulses from the movable fence HP sensor 292. The trailing edge tapping claw 221 is positioned by a control performed according to pulses from the trailing edge tapping claw HP sensor 294. The controls for positioning the movable fence 210 and the trailing edge tapping claw 221 are executed by a central processing unit (CPU) of a control circuit (not illustrated) of the saddle stitch binding apparatus 2.

Figure 4:
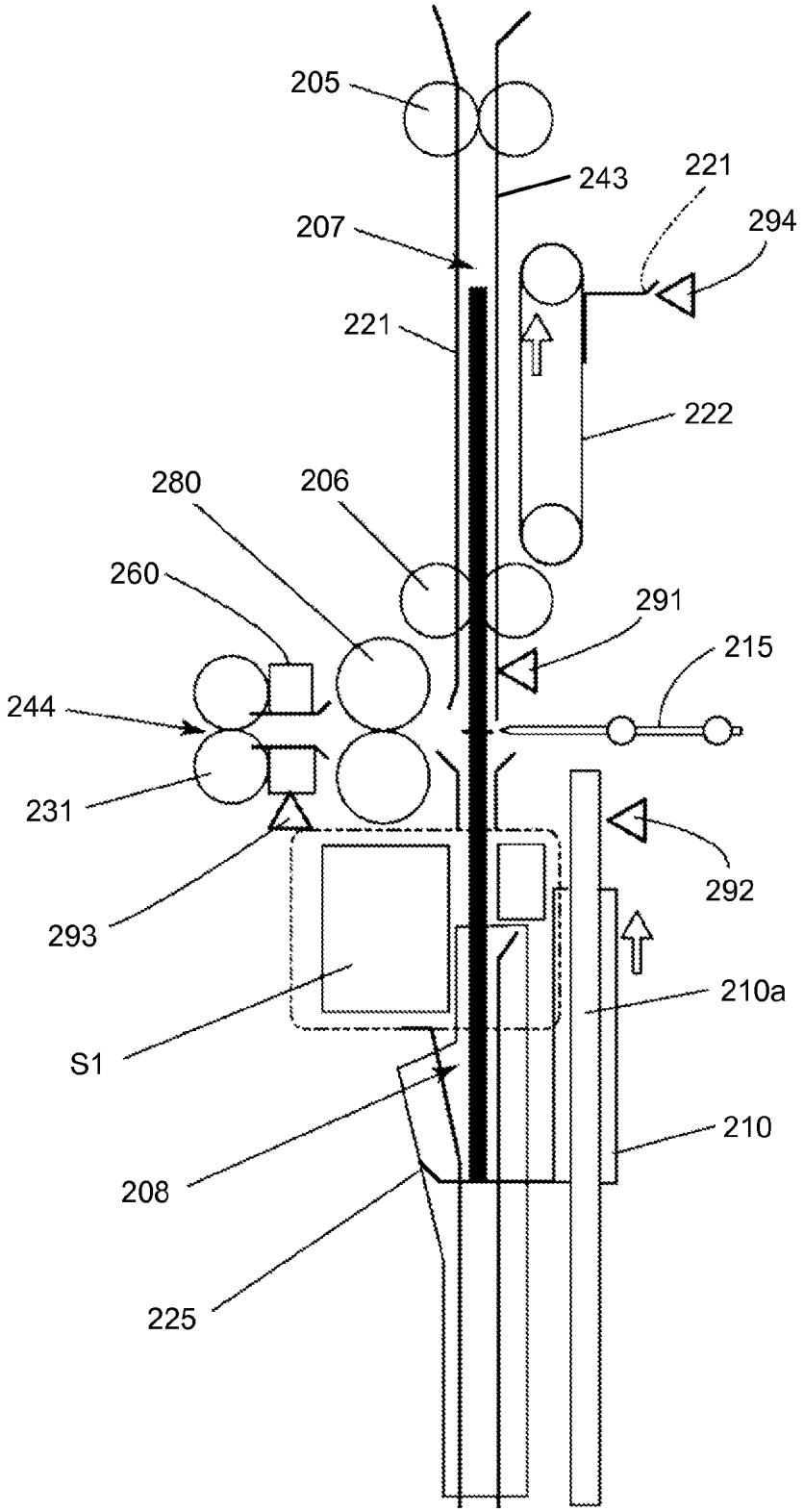
FIG. 4 is a diagram illustrating a state in which transport of the sheet bundle to a center folding position is completed in the saddle stitch binding apparatus.

After being saddle-stitched in the state illustrated in FIG. 3, the sheet bundle SB is transported to a position at which its saddle stitching position (the center of the sheet bundle SB in its conveyance direction) faces the folding plate 215 as the movable fence 210 moves upward in the state in which the pressure from the lower bundle conveyance roller 206 has been released as illustrated in FIG. 4. This position is also controlled by using the position detected by the movable fence HP sensor 292 as the reference. The folding plate 215 is a member which implements a function described below as a folding unit configured to fold the sheet bundle.

Figure 5:
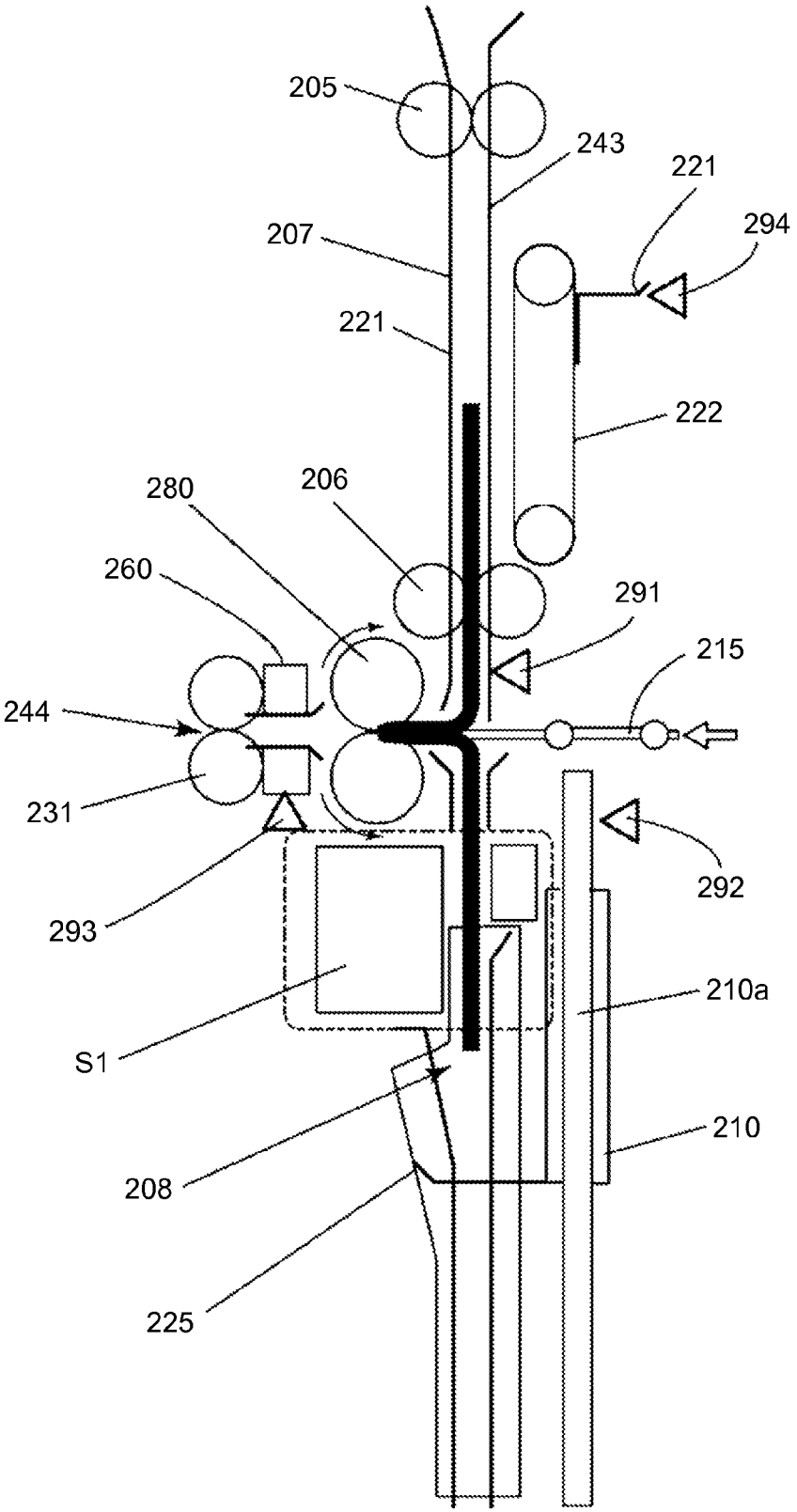
FIG. 5 is a diagram illustrating a state in which center folding processing is performed by the saddle stitch binding apparatus on the sheet bundle.

After the sheet bundle SB has reached the position illustrated in FIG. 4, the folding plate 215 moves in a direction of a nip of the folding roller pair 280 as illustrated in FIG. 5, then abuts a center portion of the sheet bundle SB present near the needles stapling the sheet bundle SB from a direction substantially perpendicular to the sheet bundle SB, and then presses the sheet bundle SB toward the nip. The sheet bundle SB is pressed by the folding plate 215 to be guided into the nip of the folding roller pair 280, and then pressed into the nip of the folding roller pair 280, which has already started rotating. The folding roller pair 280 presses and conveys the sheet bundle SB which has been pressed into the nip. The sheet bundle SB is center-folded by the press conveyance operation, and thus a briefly bound sheet bundle SB is formed. FIG. 5 illustrates a state in which the sheet bundle SB has been pinched and pressed between the nip of the folding roller pair 280 on the spine of the fold line portion SB1 (see FIG. 6).

Figure 6:
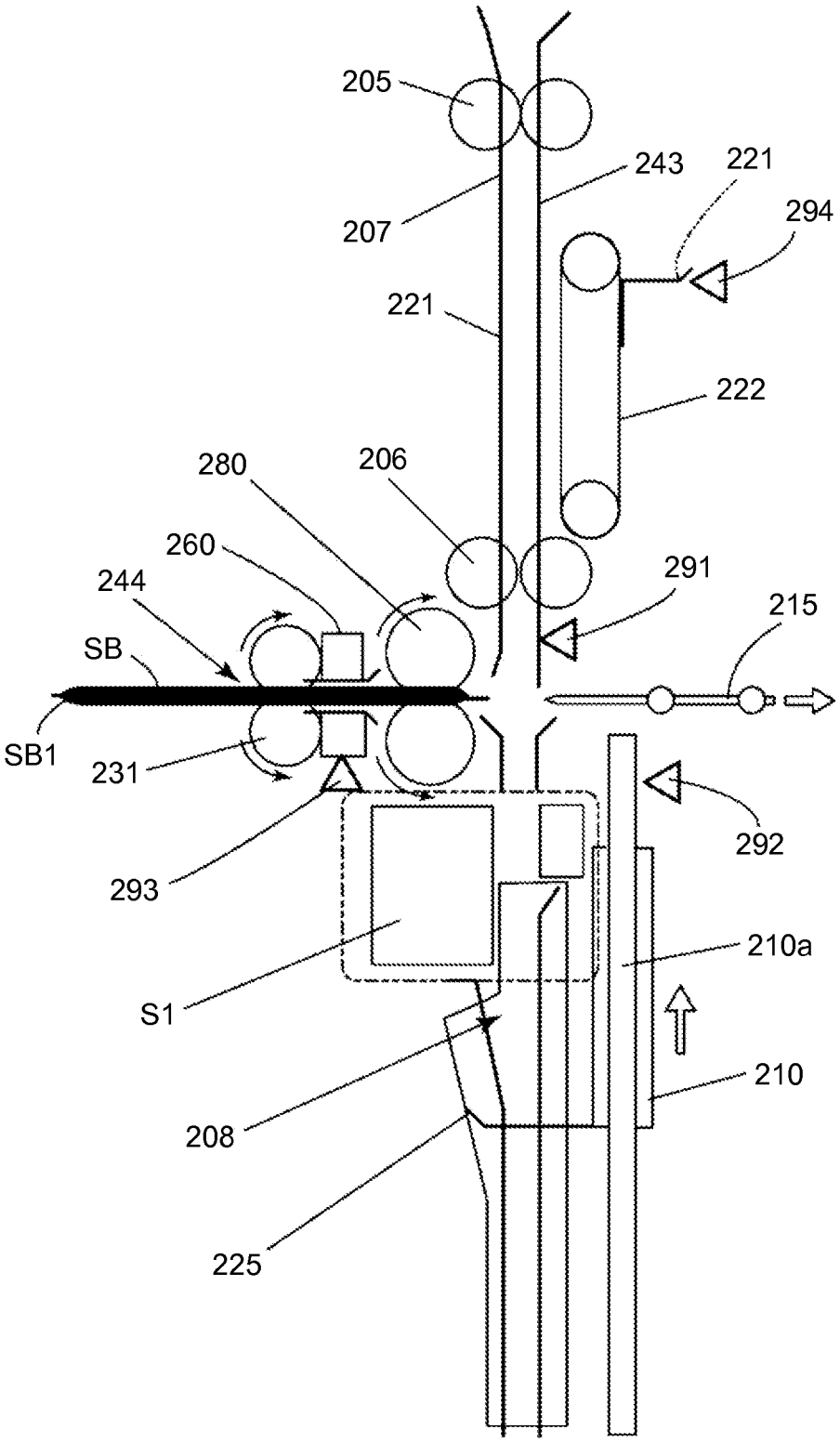
FIG. 6 is a diagram illustrating a state in which the folded sheet bundle is discharged after center folding by the saddle stitch binding apparatus on the sheet bundle is completed.

After being two-folded in the center in the state shown in FIG. 5, the sheet bundle SB is conveyed by the folding roller pair 280 as the center-folded sheet bundle SB, as illustrated in FIG. 6. Further, the center-folded sheet bundle SB is pinched by the lower discharge roller 231 to be discharged to a post-stage apparatus. In this operation, when the trailing edge of the center-folded sheet bundle SB is detected by the fold line portion passage sensor 293, the folding plate 215 and the movable fence 210 return to their home positions and the lower bundle conveyance roller 206 returns to its pressing state to be ready for a next sheet bundle SB to be fed. In addition, if the sheet size and the number of sheets for a next job are the same as those for the current job, the movable fence 210 may also move to the position illustrated in FIG. 2 again to stand by. Note that these controls are also executed by the CPU of the control circuit.

Figure 7:
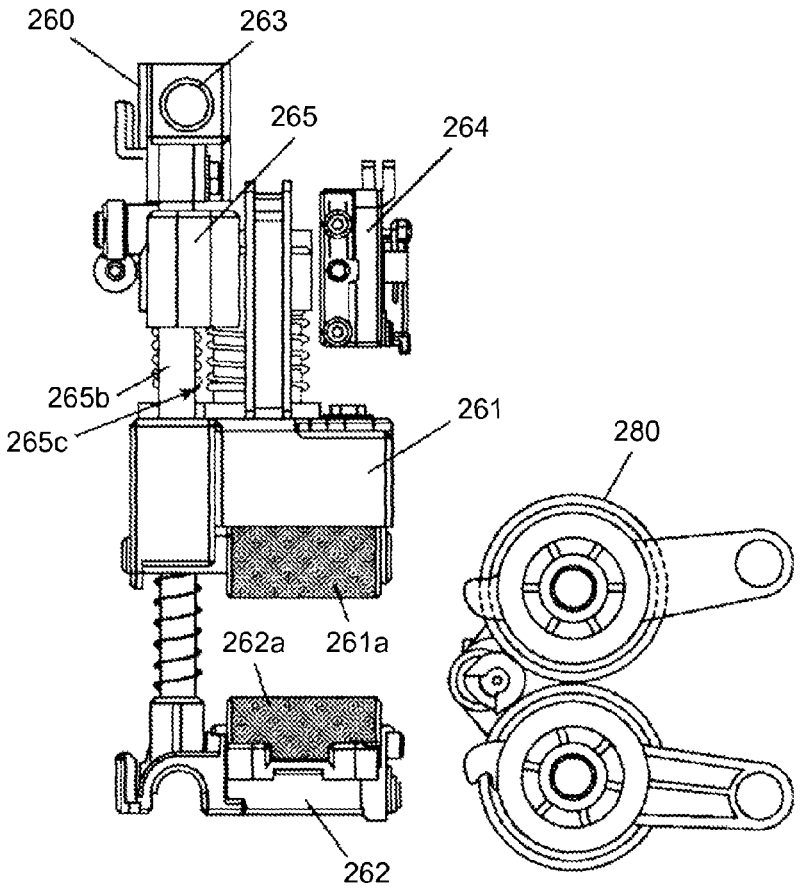
FIG. 7 is a diagram illustrating a front view of main component including an additional folding roller unit and a folding roller pair.
Figure 8:
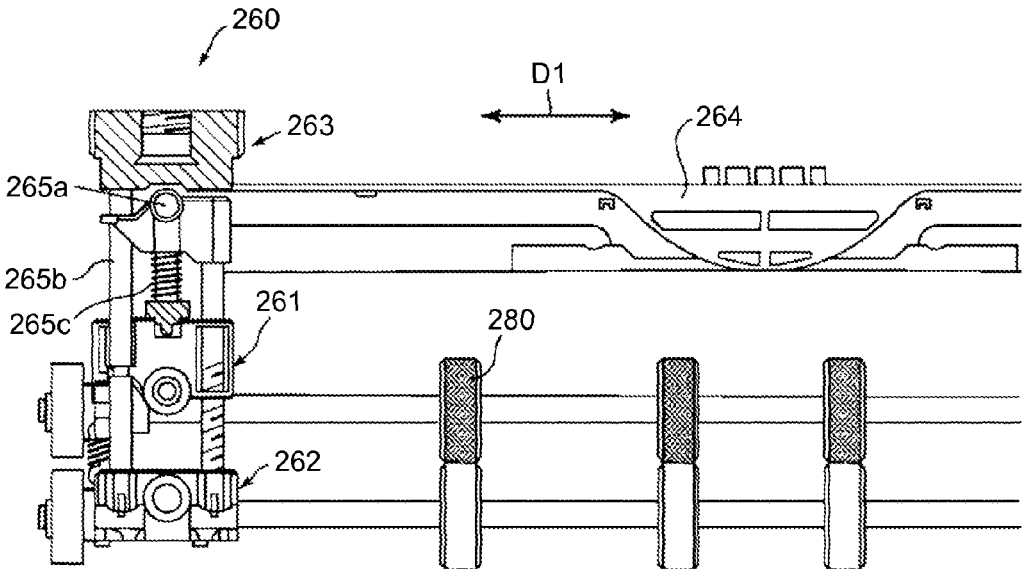
FIG. 8 is a side view of main components illustrating the portion illustrated in FIG. 7 viewed from the left.

FIG. 7 is a front view of main portions illustrating the additional folding roller unit 260 and the folding roller pair 280. FIG. 8 is a side view of main portions illustrating the portions illustrated in FIG. 7 viewed from the left.

The additional folding roller unit 260 is provided in the discharge conveyance path 244, which is disposed between the folding roller pair 280 and the lower discharge roller 231. The additional folding roller unit 260 is provided with a unit moving mechanism 263, a guide member 264, and a pressing mechanism 265. The unit moving mechanism 263 allows the additional folding roller unit 260 to reciprocate in a direction of depth in FIG. 7 (in a direction perpendicular to the sheet conveyance direction) along the guide member 264 by using a drive source (not illustrated) and a drive mechanism (not illustrated). The pressing mechanism 265 is a mechanism configured to press the center-folded sheet bundle SB by applying pressure thereto by moving in the vertical direction. The pressing mechanism 265 includes an additional folding roller/upper unit 261 and an additional folding roller/lower unit 262.

The additional folding roller/upper unit 261 is vertically movably supported by a supporting member 265*b* against the unit moving mechanism 263. The additional folding roller/lower unit 262 is immovably attached to the supporting member 265*b* of the pressing mechanism 265 at the lower end thereof. The additional folding roller unit 260, which is used as the pressing member, is configured to return to a standby position described below when the additional folding is completed and start to move from the standby position when the additional folding is started.

An upper additional folding roller 261*a* of the additional folding roller/upper unit 261 is equivalent to a pressing member longitudinally oriented along the sheet conveyance direction. The upper additional folding roller 261*a* can contact a lower additional folding roller 262*a* by press contact. With this configuration, the center-folded sheet bundle SB is pinched by these rollers in the nip between them to be pressed therein. The pressurizing force is applied by a pressure spring 265*c*, which presses the additional folding roller/upper unit 261 with elastic force. Then the additional folding roller unit 260 moves in the widthwise direction of the center-folded sheet bundle (in a direction indicated by an arrow D1 in FIG. 8) in the pressurized state and performs additional folding onto the fold line portion SB1.

Figure 9:
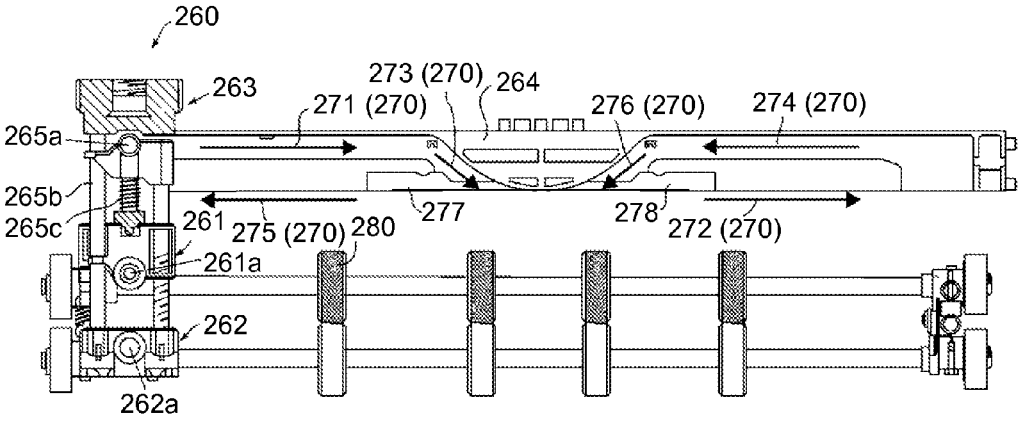
FIG. 9 is a diagram illustrating details of guide members.

FIG. 9 illustrates details of the guide member 264. The guide member 264 includes a guide path 270 for guiding the additional folding roller unit 260 in the widthwise direction of the center-folded sheet bundle SB. The guide path 270 includes the following plurality of paths.

1) A first guide path 271 for guiding the pressing mechanism 265 in the unpressing state during the forward motion 2) A second guide path 272 for guiding the pressing mechanism 265 in the pressing state during the forward motion 3) A third guide path 273 for switching the state of the pressing mechanism 265 from the unpressing state to the pressing state during the forward motion 4) A fourth guide path 274 for guiding the pressing mechanism 265 in the unpressing state during the backward motion 5) A fifth guide path 275 for guiding the pressing mechanism 265 in the pressing state during the backward motion 6) A guide path 276 for switching the state of the pressing mechanism 265 from the unpressing state to the pressing state during the backward motion These six paths are set as the paths included in the guide path 270.

The guide member 264 is a member used as one of the means for moving the additional folding roller unit 260 including a pressing member for pressing the portion to be folded in the direction of the fold line.

Figure 10:
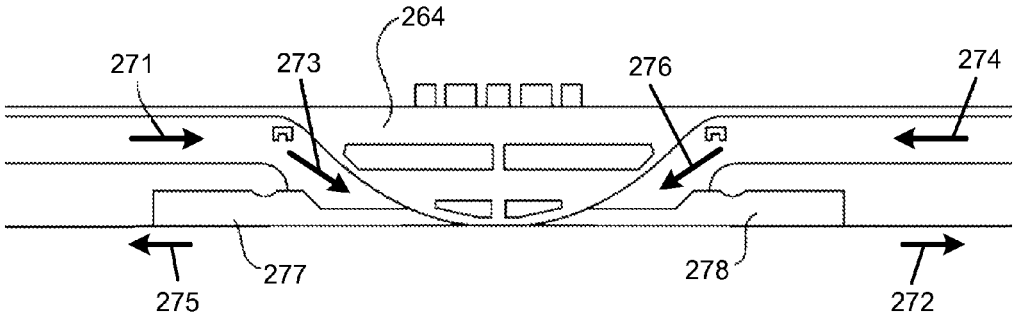
FIG. 10 is an enlarged view of the main components illustrated in FIG. 9 and illustrates a state in which the position of a path switching claw has not been switched yet.
Figure 11:
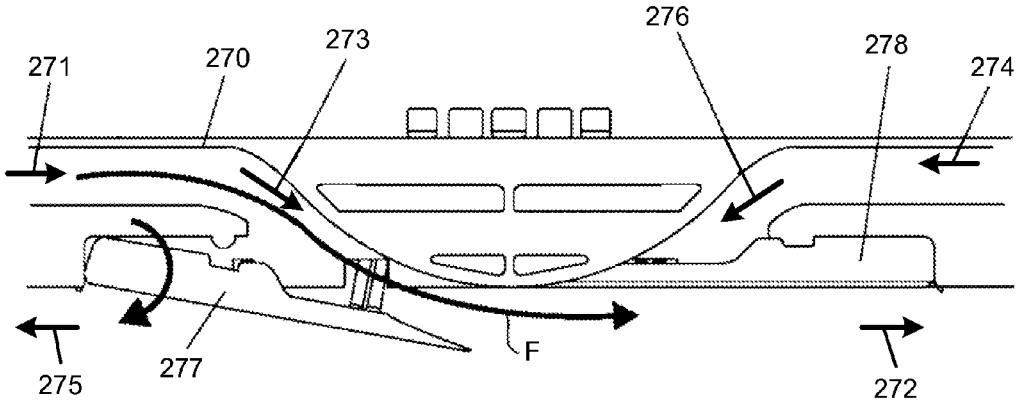
FIG. 11 is an enlarged view of the main components illustrated in FIG. 9 and illustrates a state in which the position of a first path switching claw has been switched.

FIGS. 10 and 11 are enlarged views illustrating the main portions of the example shown in FIG. 9. As shown in FIGS. 10 and 11, a first path switching claw 277 and a second path switching claw 278 are provided at an intersection of the third guide path 273 and the second guide path 272 and at an intersection of the sixth guide path 276 and the fifth guide path 275, respectively. The first path switching claw 277 is capable of switching the path from the third guide path 273 to the second guide path 272 as illustrated in FIG. 11. The second path switching claw 278 is capable of switching the path from the sixth guide path 276 to the fifth guide path 275.

However, the former cannot switch the path from the second guide path 272 to the third guide path 273 and the latter cannot switch the path from the fifth guide path 275 to the sixth guide path 276. In other words, the claws are configured so that it cannot switch the paths in the reverse direction.

In addition, the pressing mechanism 265 moves along the guide path 270 because a guide pin 265*a* of the pressing mechanism 265 is movably fitted into the guide path 270 in a loosely-fit state. In other words, the guide path 270 functions as a cam groove and the guide pin 265*a* functions as a cam follower which changes its position while moving along the cam groove. In FIG. 11, an arrow F indicates the direction in which the guide pin 265*a* moves from the first guide path 271 toward the second guide path 272.

FIGS. 12 to 22 are operation explanatory views illustrating an additional folding operation by the additional folding roller unit according to the present embodiment.

Figure 12:
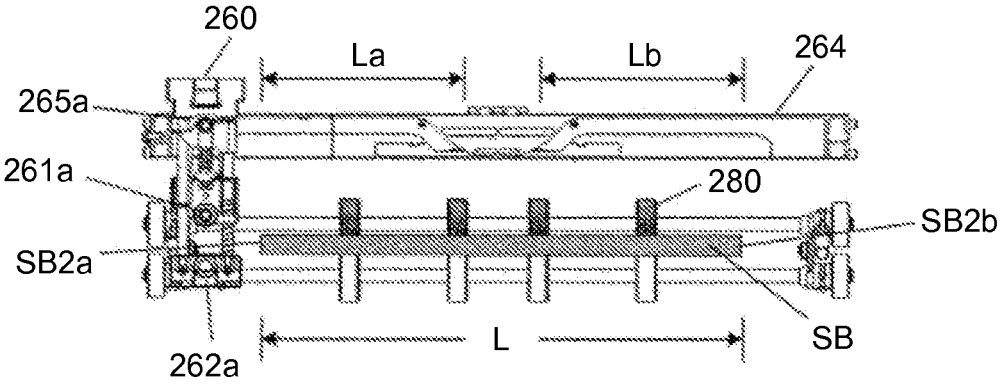
FIG. 12 is a diagram illustrating an initial state of an additional folding operation.

FIG. 12 illustrates a state in which after being folded by the folding roller pair 280, the center-folded sheet bundle SB has been conveyed to and stopped at a previously set additional folding position and the additional folding roller unit 260 is positioned in its standby position. The position in this state is an initial position for the additional folding operation.

In this position, the upper additional folding roller 261*a* and the lower additional folding roller 262*a*, which are pressing members included in the additional folding roller unit 260, separate from each other and stand by in the unpressing state in which no pressure is applied to the center-folded sheet bundle SB, i.e., in a non-pressing state.

Figure 13:
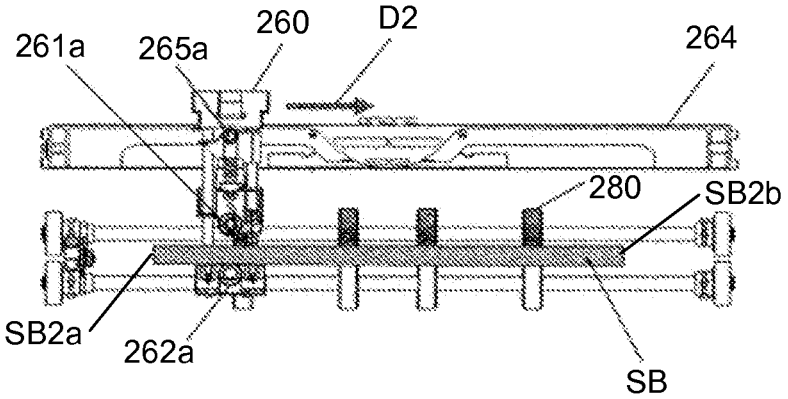
FIG. 13 is a diagram illustrating a state in which a forward motion of the additional folding roller unit is started.

The additional folding roller unit 260 starts the forward motion from the initial position (FIG. 12) to the right in the drawing (in a direction indicated by an arrow D2) (FIG. 13). At this timing, the pressing mechanism 265 in the additional folding roller unit 260 moves along the guide path 270 of the guide member 264 due to an action of the guide pin 265*a*. The pressing mechanism 265 moves along the first guide path 271 immediately after the start of the operation. At this timing, the additional folding roller pair 261*a*, 262*a* is in the unpressing state. The unpressing state herein refers to a state in which the additional folding rollers 261*a*, 262*a* and the center-folded sheet bundle SB are in contact with one another but substantially no pressure has been applied or a state in which the additional folding rollers 261*a*, 262*a* are separated from the center-folded sheet bundle SB.

Figure 14:
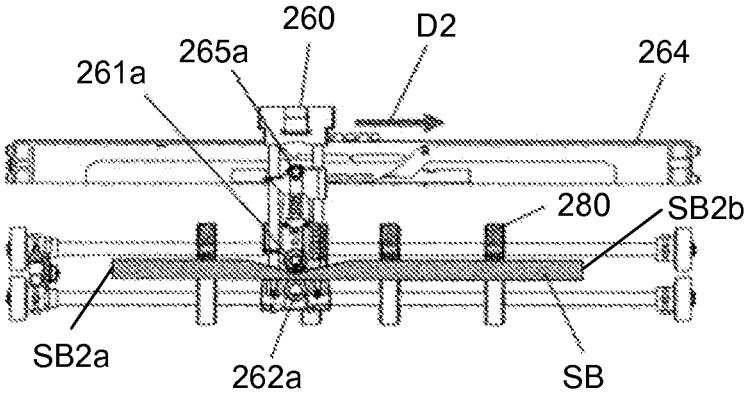
FIG. 14 is a diagram illustrating a state in which the additional folding roller unit has reached a third guide path at a location near the center of the sheet bundle.
Figure 15:
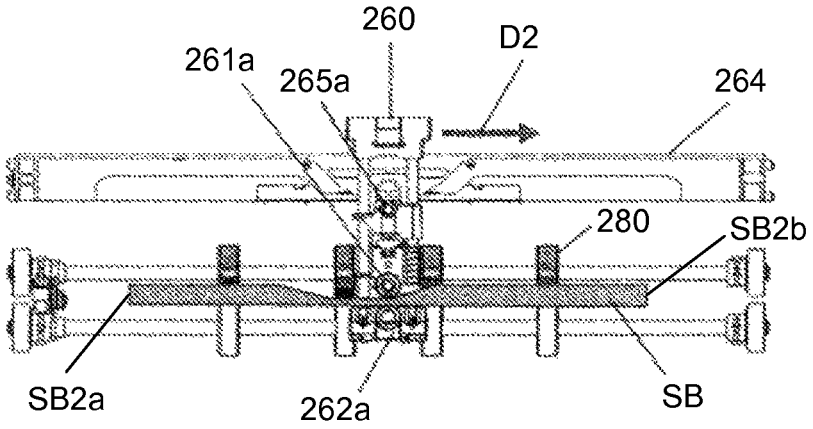
FIG. 15 is a diagram illustrating a state in which the additional folding roller unit enters a second guide path by pushing the first path switching claw away.
Figure 23:
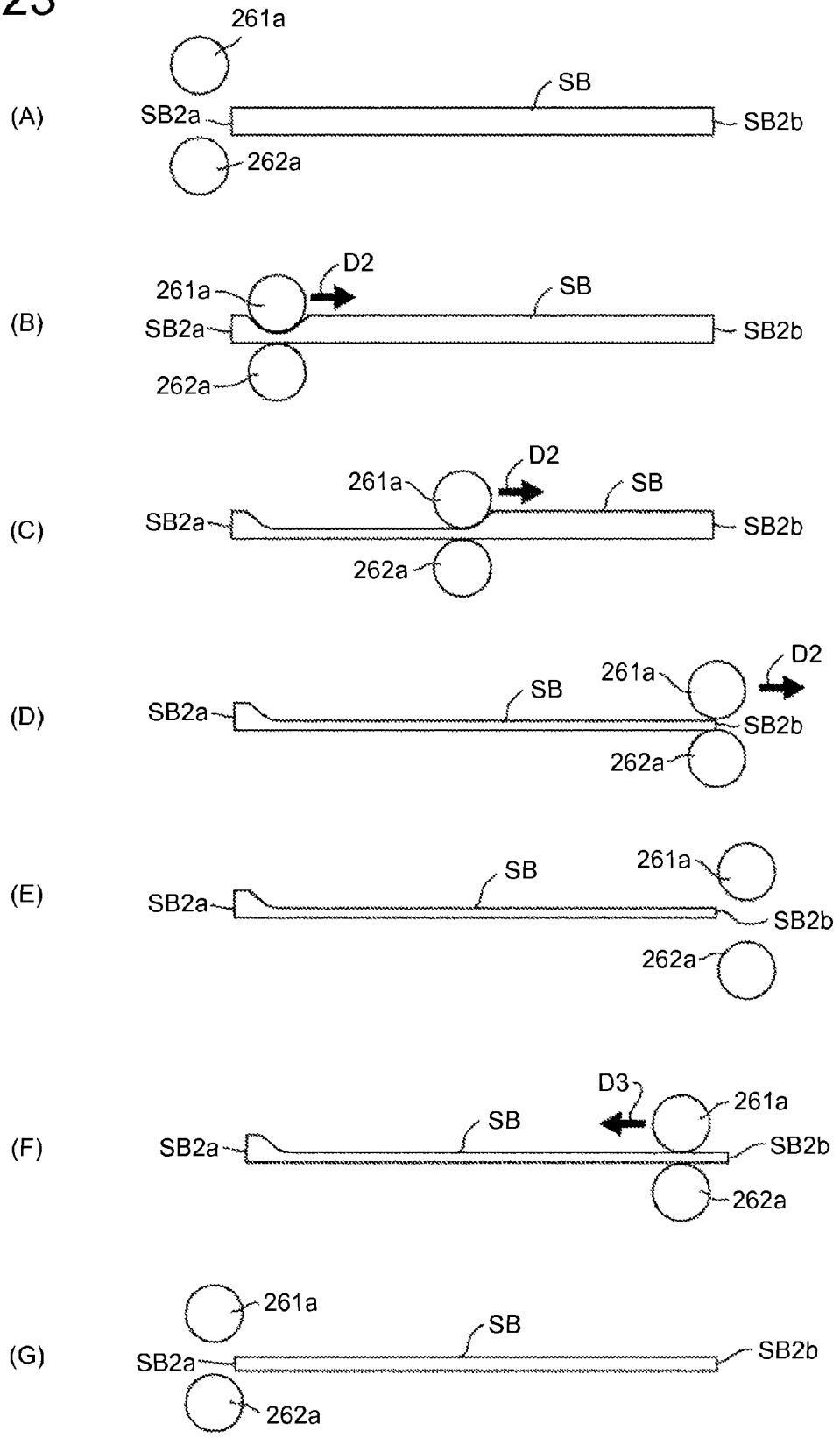
FIG. 23 is a schematic view illustrating another example of the additional folding operations illustrated in FIGS. 12 to 22.

In the course of moving from the initial position, the additional folding roller pair 261*a*, 262*a* reaches the third guide path 273 inside one edge SB2*a* of the center-folded sheet bundle SB in the widthwise direction (FIG. 14) (preferably in the center of the center-folded sheet bundle as illustrated in FIG. 14, however, the roller pair may reach the third guide path 273 at a position near one edge SB2*a* of the center-folded sheet bundle SB as illustrated in FIG. 23). In this state, the pressing mechanism 265 starts descending along the third guide path 273 and then enters the second guide path 272 while pushing the first path switching claw 277 away (FIG. 15). At this timing, the pressing mechanism 265 presses the additional folding roller/upper unit 261 and the additional folding roller/upper unit 261 abuts the center-folded sheet bundle SB, i.e., the state of the pressing mechanism 265 shifts to the pressing state.

Figure 16:
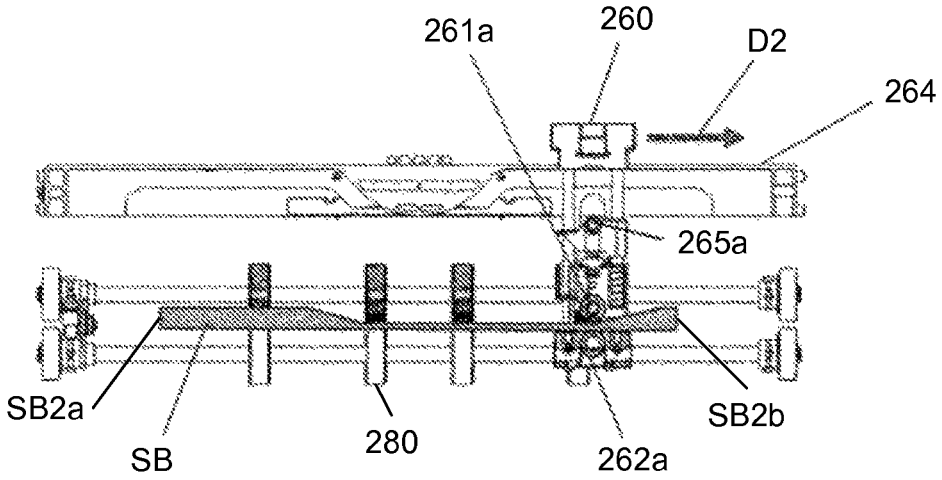
FIG. 16 is a diagram illustrating a state in which the additional folding roller unit moves toward an edge of the sheet bundle while continuously pressing the sheet bundle.
Figure 17:
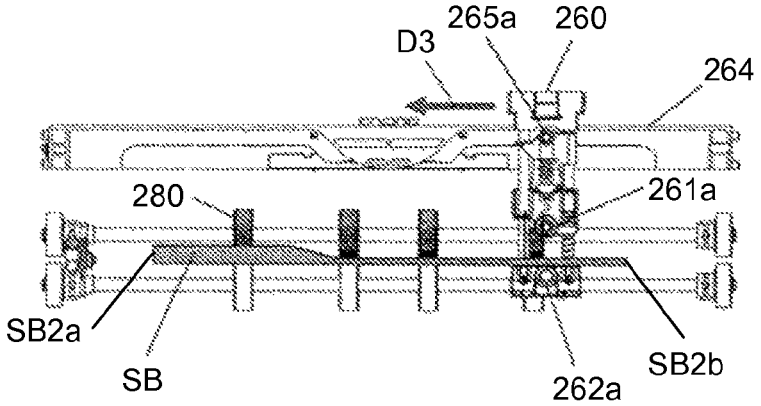
FIG. 17 is a diagram illustrating a state in which the additional folding roller unit has moved along the second guide path to a forward motion final position.

While maintaining the pressing state, the additional folding roller unit 260 further moves in a direction indicated by an arrow D2 (FIG. 16). In this state, because the second path switching claw 278 cannot move in the reverse direction, the second path switching claw 278 moves along the second guide path 272 without being guided into the sixth guide path 276. Thus the additional folding roller unit 260 comes out of the center-folded sheet bundle SB from the other edge SB2*b* thereof in the widthwise direction to be positioned at a final position of the forward motion (FIG. 17). After the additional folding roller unit 260 has reached this position, the guide pin 265*a* of the pressing mechanism 265 shifts from the second guide path 272 to the fourth guide path 274. As a result, the positional restriction by an upper surface of the second guide path 272 against the guide pin 265*a* is released. Accordingly, the upper additional folding roller 261*a* is allowed to separate from the lower additional folding roller 262*a*, and the state of the pressing mechanism 265 becomes the unpressing state.

Figure 18:
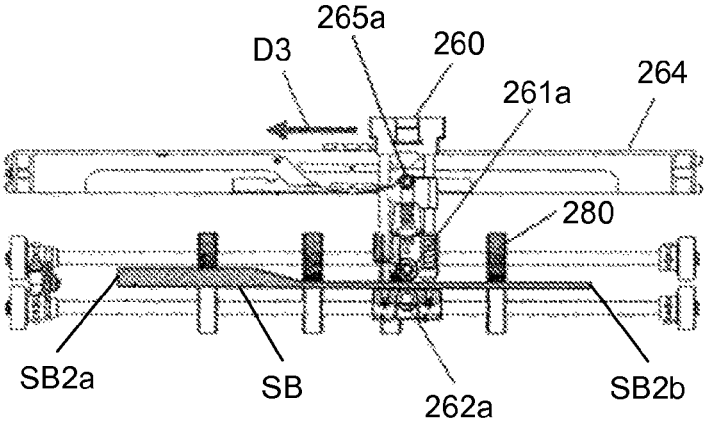
FIG. 18 is a diagram illustrating a state in which the additional folding roller unit has started a backward motion by moving from the forward motion final position.
Figure 19:
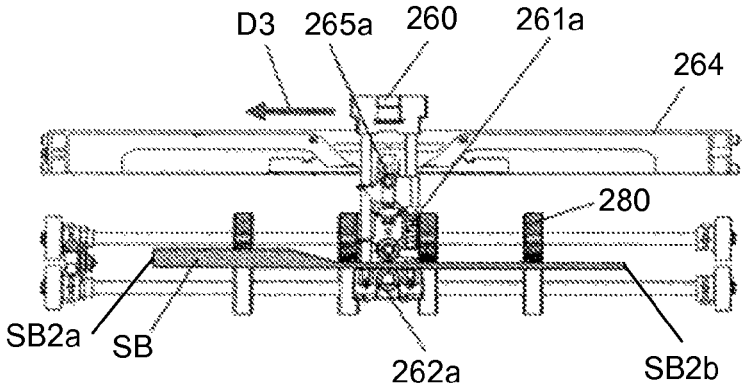
FIG. 19 is a diagram illustrating a state in which the additional folding roller unit has started the backward motion and reached a sixth guide path.
Figure 20:
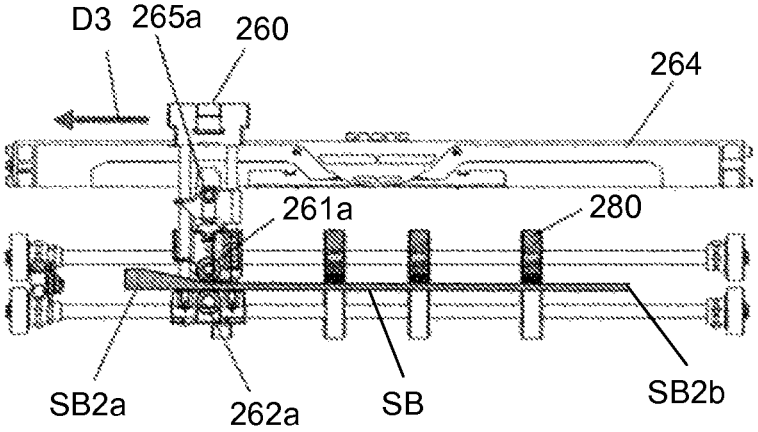
FIG. 20 is a diagram illustrating a state in which the additional folding roller unit has reached the sixth guide path and shifts from an unpressing state to a pressing state.
Figure 21:
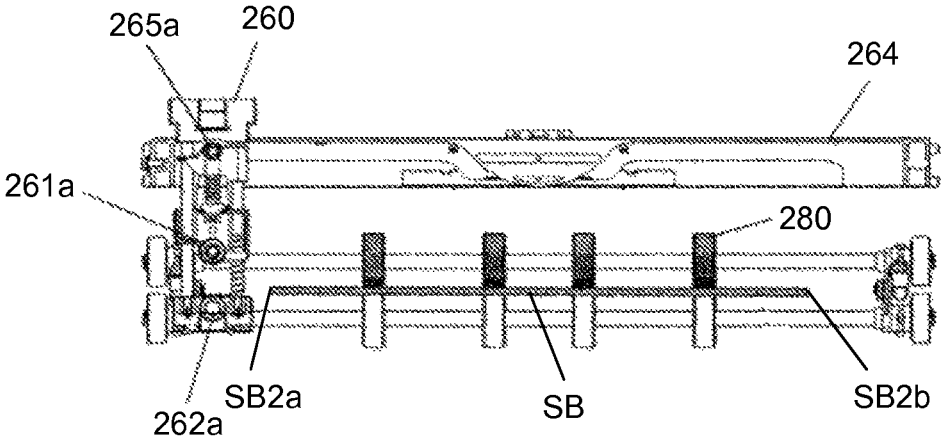
FIG. 21 is a diagram illustrating a state in which the additional folding roller unit has moved from the sixth guide path and entered the fifth guide path and then has shifted to a full-pressing state.

Subsequently, the unit moving mechanism 263 allows the additional folding roller unit 260 to start the backward motion (FIG. 18). In the backward motion, the pressing mechanism 265 moves to the left in the drawing (in a direction indicated by an arrow D3) along the fourth guide path 274. After the pressing mechanism 265 has reached the sixth guide path 276 inside the other edge SB2*b* of the center-folded sheet bundle SB (FIG. 19) (preferably in the center of the center-folded sheet bundle SB as illustrated in FIG. 19, however, the pressing mechanism 265 may reach the sixth guide path 276 near the other edge SB2*b* of the center-folded sheet bundle as shown in FIG. 23), the guide pin 265*a* is pressed downward along the shape of the sixth guide path 276 and the state of the pressing mechanism 265 shifts from the unpressing state to the pressing state (FIG. 20).

Figure 22:
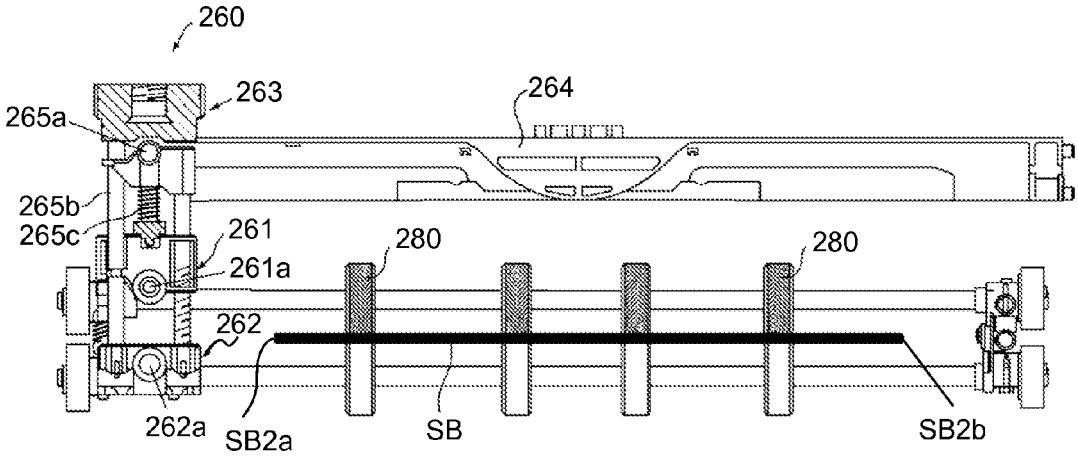
FIG. 22 is a diagram illustrating a state in which the additional folding roller unit has moved along the fifth guide path forward the edge of the folded sheet bundle and returned to its initial position.

After entering the fifth guide path 275, the state of the pressing mechanism 265 becomes a full-pressing state, and the pressing mechanism 265 moves along the fifth guide path 275 in the direction of the arrow D3 without moving to another path (FIG. 21) and then comes out of the one edge SB2*a* of the center-folded sheet bundle SB (FIG. 22).

In the above-described manner, the additional folding roller unit 260 is allowed to reciprocate to perform additional folding on the center-folded sheet bundle SB. In this additional folding, the additional folding from the center of the sheet bundle SB toward the other edge SB2*b* of the center-folded sheet bundle SB is started first and the pressing mechanism 265 comes out of the sheet bundle SB from the other edge SB2*b* of the center-folded sheet bundle SB. Then the pressing mechanism 265 moves over the additional-folding-completed portion of the center-folded sheet bundle SB, then starts additional folding from the center of the center-folded sheet bundle SB toward the one edge SB2*a*, and then comes out of the center-folded sheet bundle from the one edge SB2*a*. The additional folding is performed by these operations.

By performing the above-described operations, the additional folding roller pair 261*a*, 262*a* neither contacts nor presses the sheet bundle SB on the edges SB2*a* and SB2*b* of the center-folded sheet bundle SB from outside thereof when the additional folding is started or when the pressing mechanism 265 comes out of the center-folded sheet bundle SB from one edge SB2*a* and returns to the other edge SB2*b* thereof. In other words, in coming out of the center-folded sheet bundle SB over the edge SB2*a*(SB2*b*) from outside the edge 2Ba (SB2*b*), the additional folding roller unit 260 is in the unpressing state, and thus the center-folded sheet bundle SB would not be damaged on the edges SB2*a* and SB2*b*. In addition, because the additional folding is started from a location close to the center of the center-folded sheet bundle SB toward the edges SB2*a*, SB2*b*, the travel of the additional folding roller unit 260 running in contact with the center-folded sheet bundle SB during the additional folding becomes short, and thus twists of the center-folded sheet bundle SB causing wrinkles, etc. hardly accumulate. Accordingly, the center-folded sheet bundle SB would not be damaged on the edges SB2*a*, SB2*b* during additional folding on the fold line portion (spine) SB1 of the center-folded sheet bundle SB, which enables suppression of curls and wrinkles occurring in and near the fold line portion SB1 due to accumulation of twists.

Note that the state in which the additional folding operation is started from the center of the center-folded sheet bundle SB in the widthwise direction is described with reference to FIGS. 12 to 22, while in FIGS. 23(A) to 23(G), a state is described in which the additional folding operation is started from a position close to one edge SB2*a* of the center-folded sheet bundle SB in the widthwise direction and from a position close to the other edge SB2*b* thereof.

The additional folding operation illustrated in FIG. 23S. 23(A) to 23(G) can be performed by modifying the configuration of the guide path 270 illustrated in FIG. 9 to a configuration in which it is enabled to start the pressing state from near one edge SB2*a* and the other edge SB2*b* of the center-folded sheet bundle SB in the widthwise direction. Note that the examples illustrated in FIGS. 23(A) to 23(G) are equivalent to those illustrated in FIGS. 12, 14 to 17, 19, and 22.

The above-described additional folding operation is intended to be carried out by moving the additional folding roller unit 260 in relation to the center-folded sheet bundle SB. However, processing can also be used in the present invention in which the center-folded sheet bundle SB is moved in relation to the additional folding roller unit.

More specifically, alternatively, a configuration can also be employed in which the fold line portion is pressed and turned by the additional folding rollers while the additional folding roller unit 260 has been stopped in the direction of fold line of the center-folded sheet bundle SB to convey the center-folded sheet bundle SB in the direction of the fold line, thereby additional folding process is completed.

Figure 24:
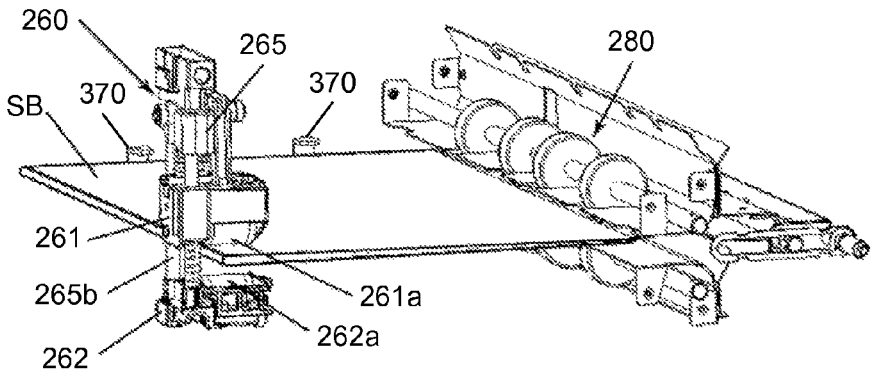
FIG. 24 is a diagram illustrating another example with respect to a relationship between the folded sheet bundle and an additional folding mechanism used in the additional folding operations illustrated in FIGS. 12 to 22.
Figure 24:
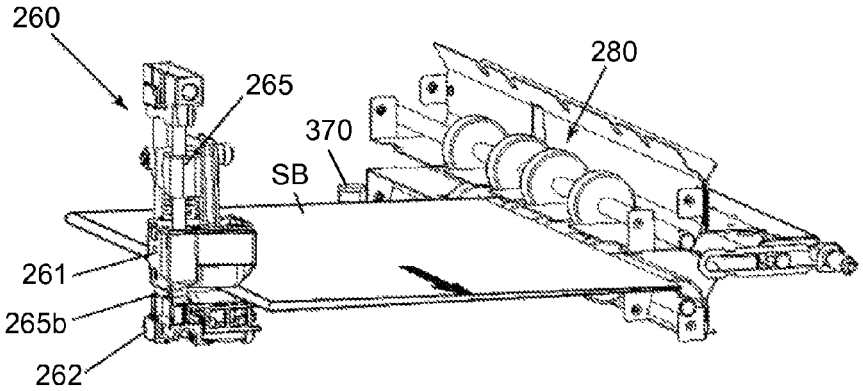
Figure 24:
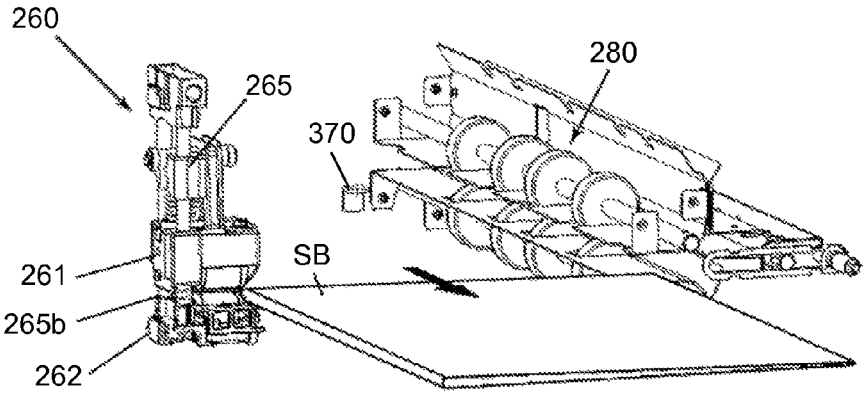

FIG. 24 illustrates processing for performing an additional folding operation by moving the sheet bundle SB against the additional folding roller unit 260 that is positionally-fixed. More specifically, FIG. 24 illustrates a configuration for performing the additional folding operation among the members illustrated therein.

In FIG. 24, after being conveyed by a folding roller pair 280, the center-folded sheet bundle SB is conveyed by a sheet bundle conveyance member 370 toward an additional folding roller unit 260. The center-folded sheet bundle SB are received in a state in which an additional folding roller/upper unit 261 is separated, and when the additional folding roller/upper unit 261 comes close to an additional folding roller/lower unit 262, an additional folding roller 261*a* abuts onto an additional folding roller 262*a* and is turned there. Having been pinched between the additional folding rollers 261*a*, 262*a*, the center-folded sheet bundle SB is conveyed in the direction of the fold line due to the rotation of both rollers, and thus additional folding can be performed onto the fold line portion of the center-folded sheet bundle SB. Note that although not described in detail, an operation for allowing the additional folding rollers 261*a* and 262*a* to contact and separate from each other can be performed in the following manner, for example, such that the rollers 261*a* and 262*a* are allowed to ascend and descend by using plungers, etc. (not illustrated) at timings set according to results of detection for the position of the leading edge of the center-folded sheet bundle SB in the conveyance direction during the additional folding.

The following conditions are used to prevent the additional folding roller pair 261*a*, 262*a* from being moved onto the edges SB2*a*, SB2*b* of the center-folded sheet bundle SB from outside the edges SB2*a*, SB2*b*.

As can be understood from the operations illustrated in FIGS. 12 to 22, it is assumed that the distance traveled by the additional folding roller unit 260 in the unpressing state during the forward motion is denoted by La, and the distance traveled by the additional folding roller unit 260 in the unpressing state during the backward motion is denoted by Lb, it is imperative that the size L of the center-folded sheet bundle in the widthwise direction, the distance La, and the distance Lb have the relationship expressed as:

$$L>La+Lb$$

(see, FIGS. 12 to 14 and 17 to 19).

In addition, it is preferable to set substantially the same value for the distance La, Lb and start the pressing from a position near the center of the center-folded sheet bundle SB in the widthwise direction (FIGS. 16 and 20).

In the additional folding roller unit 260 according to the present embodiment, the additional folding roller/lower unit 262 is provided and the additional folding is performed by the additional folding roller pair 261*a*, 262*a*. However, note that the additional folding can be performed by a different method. For example, a configuration can be employed in which the additional folding roller/lower unit 262 is omitted, the additional folding roller/upper unit 261 and a receiving member (not illustrated) having an abutment surface facing the additional folding roller/upper unit 261 are provided, and the center-folded sheet bundle SB is pressed between them.

Further, in the additional folding roller unit 260 according to the present embodiment, the additional folding roller/upper unit 261 is configured to be vertically movable and the additional folding roller/lower unit 262 is configured to be vertically immovable. However, the following configuration can be employed instead of this configuration.

More specifically, the additional folding roller/lower unit 262 can also be configured to be vertically movable. With this configuration, the upper and the lower rollers 261*a*, 262*a* contact and separate symmetrically in relation to the position of the additional folding. Accordingly, the position of the additional folding becomes constant regardless of the thickness of the center-folded sheet bundle SB, which further enables suppression of damages to the center-folded sheet bundle SB, such as flaws.

A characteristic of the sheet processing apparatus with the above-described configuration will be described below.

The characteristic of the sheet processing apparatus according to the present embodiment is that the travel required for the additional folding roller unit for additional folding is reduced by setting a position close to the center of the center-folded sheet bundle SB in the widthwise direction as the standby position from which the additional folding by the additional folding roller unit is started.

Figure 25:
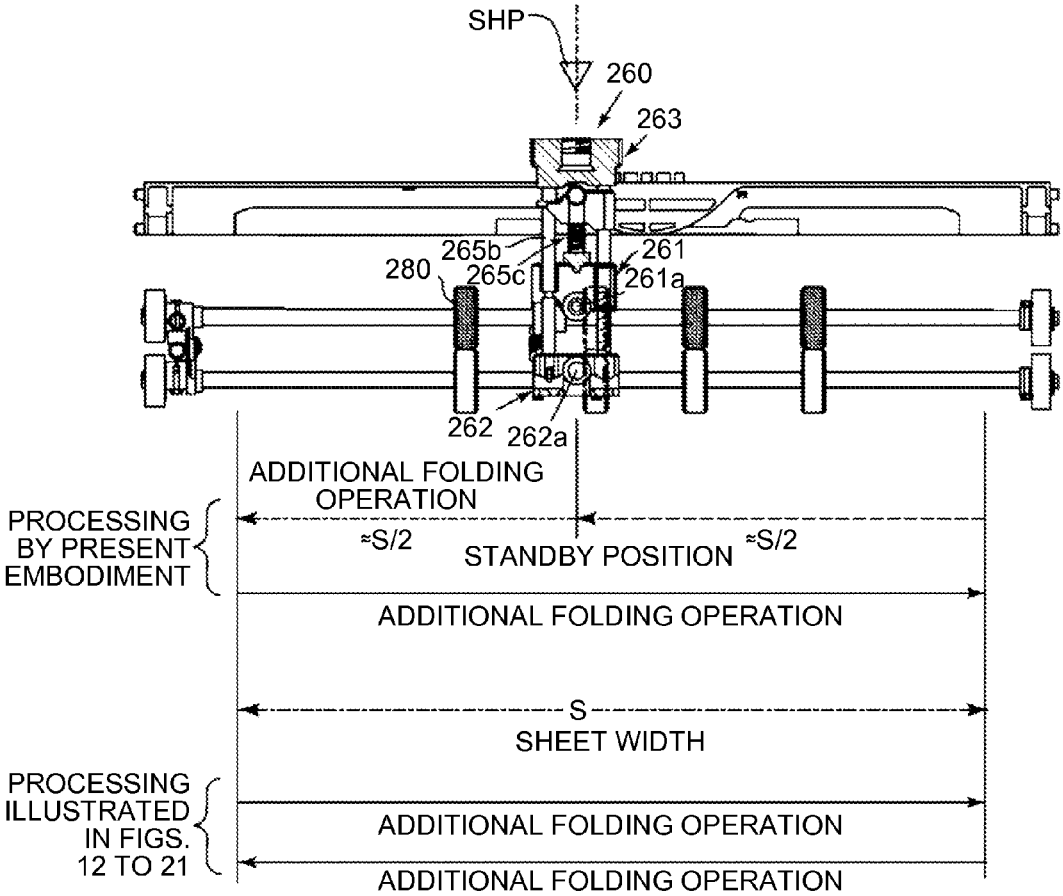
FIG. 25 is a diagram illustrating a characteristic of the sheet processing apparatus according to an embodiment of the present invention having the configurations illustrated in FIGS. 1 to 22.

FIG. 25 illustrates a state in which the additional folding roller unit 260, which has been positioned outside the edge of the center-folded sheet bundle SB in the widthwise direction before the center-folded sheet bundle SB reaches the additional folding location, has moved to the standby position to prepare for the additional folding.

In the present embodiment, the standby position is fixed to a position close to the center of the center-folded sheet bundle SB to be additionally folded in the direction of the width S of the center-folded sheet bundle SB (a position illustrated with expressions "≈S/2" in FIG. 25).

For the standby position in which the additional folding roller unit 260 is set, a position corresponding to the most downstream location in the first guide path 271 illustrated in FIGS. 9 and 10 is set. More specifically, a position in which the additional folding roller pair 261*a*, 262*a* separate from each other and the non-pressing state can be achieved is set as the standby position.

Accordingly, the conveyance of the center-folded sheet bundle which has been additionally folded by the additional folding roller pair 261*a*, 262*a* is not inhibited.

In the additional folding roller unit 260, the additional folding operations illustrated in FIGS. 12 to 22 are performed after the additional folding roller unit 260 is positioned to the standby position at the start of the additional folding. To describe the time required for the above-described additional folding operations, time for moving the first guide path 271 is saved compared with the case where a position outside the sheet width S is set as the standby position.

More specifically, the moving of the additional folding roller unit 260 illustrated in FIGS. 12 to 14 is omitted, and accordingly, time required for this moving is subtracted from the total additional folding operation time to reduce the operation time.

In the present embodiment, in positioning the additional folding roller unit 260 to its standby position, the additional folding roller unit 260 moves at a speed higher than that set for the additional folding.

Accordingly, the operation time can be further reduced.

Figure 26:
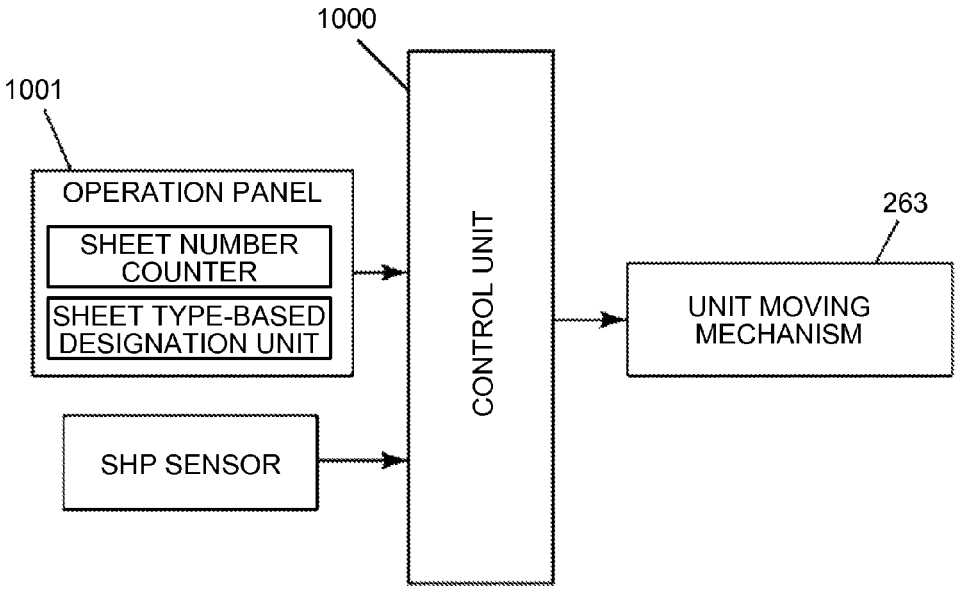
FIG. 26 is a block diagram illustrating a configuration of a control unit used in the sheet processing apparatus illustrated in FIG. 25.

The above-described operation of the additional folding roller unit 260 is driven and controlled by a control unit 1000 illustrated in FIG. 26.

FIG. 26 is a block diagram illustrating a configuration of the control unit used for driving and controlling the additional folding roller unit 260.

The control unit 1000 is a unit configured to execute a control including an image forming sequence performed by the image forming apparatus PR. As configurations related to the present embodiment, an operation panel 1001 and a standby position detection sensor SHP (see FIG. 25) are connected to the input of the control unit 1000.

A drive source for the unit moving mechanism 263 (see FIG. 8) is connected to the output of the control unit 1000.

The operation panel 1001 is provided with input devices (not illustrated) for inputting designations of various information and a display unit (not illustrated) for displaying the various information, and the like. As configurations related to the present embodiment, switches for designating information such as information about the size of the sheet in the widthwise direction, the type of the sheet, the number of sheets included in one sheet bundle, whether to perform the additional folding, etc. are provided.

Among the respective pieces of information, the type of the sheet is used to determine the sheet thickness. In addition to this, the number of sheets to be included in one sheet bundle, similarly, is also used to determine the thickness of the sheet bundle.

For the standby position detection sensor SHP, a standby home detection sensor capable of detecting the arrival of the additional folding roller unit 260 at the standby position is used.

In the control unit 1000, the standby position is calculated on the basis of the sheet width size, the timing and speed of moving to the standby position are set, and processing for setting the speed of moving to the standby position with being in the non-pressing state higher than the speed set for the pressing state is performed on the basis of the result of the calculation and the set timing and speed.

Figure 27:
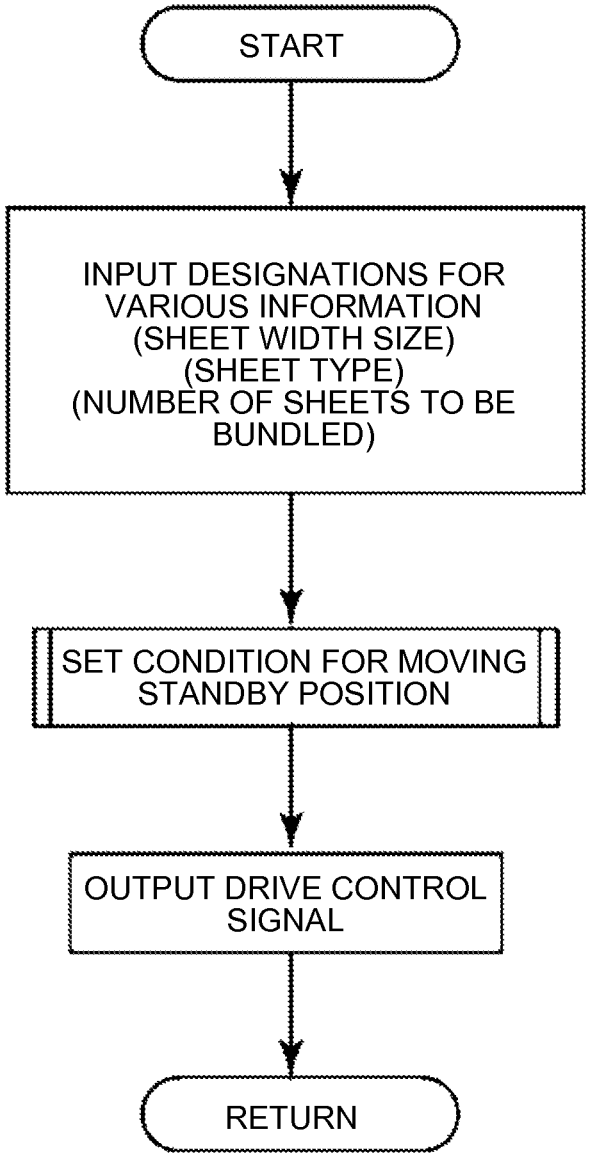
FIG. 27 is a flow chart illustrating control processing executed by the control unit illustrated in FIG. 26.

FIG. 27 is a flow chart illustrating a flow of control executed by the control unit 1000.

In FIG. 27, after various information is input, conditions for moving to the standby position are set on the basis of the respective designation information described above and then a control signal generated on the basis of the conditions is output to the drive source for the unit moving mechanism 263.

According to the above-described embodiment, a position near the center of the center-folded sheet bundle in the widthwise direction is set as the position for starting the additional folding operation in the course of the reciprocating operation of the additional folding roller unit, and thus the time required for moving the additional folding roller unit for the additional folding can be reduced compared with a case where the additional folding roller unit is moved from one edge of the center-folded sheet bundle in the widthwise direction.

Configurations which particularly enable the reduction of time include a configuration in which the additional folding roller unit is moved to the standby position at a high speed and a configuration in which the standby position is optimized according to the thickness of the sheet or the sheet bundle. By employing these configurations, the ease of work of additional folding operations can be improved particularly in the case where the operations are serially performed.

According to the present invention, because the moving unit is configured to stand by at a pressing start position while a pressing member is in a non-pressing state, time required for additional folding can be reduced by setting a position inside an edge of a sheet bundle as the pressing start position, and thus the ease of work can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member, and wherein the standby position is a position inside an edge of the folded sheet bundle, and the pressing member is configured to return to the position inside the edge of the sheet bundle, when the pressing to the sheet bundle is completed.

2. An image processing system which uses a sheet processing apparatus, the sheet processing apparatus comprising a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member, the image forming apparatus is connected as a pre-stage apparatus and the sheet processing apparatus is connected as a post-stage apparatus at locations across a position in which saddle stitching and center folding of sheets are performed, and wherein the standby position is a position inside an edge of the folded sheet bundle, and the position inside the edge of the folded sheet bundle corresponds to a position in which the pressing member is in the non-pressing state.

3. The image processing system of claim 2 wherein, the moving unit is configured to start pressing from inside one edge of the folded sheet bundle to the other edge of the folded sheet bundle and come out of the folded sheet bundle from the other edge of the folded sheet bundle.

4. The image processing system of claim 2 wherein, the standby position for the pressing member is changed according to sheet information.

5. The image processing system of claim 2 wherein, a speed higher than a speed of moving the pressing member in a pressing state is set as a speed of moving the pressing member in retracting toward the standby position with being in the non-pressing state.

6. The image processing system of claim 2 further including a control unit that drives and controls the pressing member, and operation panel, which enables designation of information such as a sheet width size, a sheet type, the number of sheets to be bundled into a sheet bundle, whether to perform additional folding, and the like, and a standby home detection sensor capable of detecting arrival of the pressing member at the standby position being connected to an input of the control unit, and a drive source for the pressing member being connected to an output of the control unit, wherein the control unit is configured to calculate the standby position based on the sheet width size, set a timing and a speed of moving to the standby position, and causes the pressing member to retract toward the standby position at a speed higher than a speed set for the additional folding.

7. A sheet processing apparatus comprising:

a pressing member configured to press a fold line portion of a folded sheet bundle; and moving unit configured to move a position of pressing by the pressing member in a direction of a fold line of the folded sheet bundle, wherein the moving unit is configured to stand by at a pressing start position in which the pressing member is in a non-pressing state, before the folded sheet bundle is conveyed to the pressing member, and wherein the standby position is a position inside an edge of the folded sheet bundle, and the position inside the edge of the folded sheet bundle corresponds to a position in which the pressing member is in the non-pressing state.

* * * * *